US009051846B2

(12) United States Patent
Arilla et al.

(10) Patent No.: US 9,051,846 B2
(45) Date of Patent: Jun. 9, 2015

(54) RING SEGMENT POSITIONING MEMBER

(75) Inventors: Jean-Baptiste Arilla, Pau (FR); Denis Chanteloup, Gelos (FR); Yvan Lameignere, Vic en Bigorre (FR)

(73) Assignee: TURBOMECA, Bordes (FR)

( * ) Notice: Subject to any disclaimer, the term of this patent is extended or adjusted under 35 U.S.C. 154(b) by 812 days.

(21) Appl. No.: 13/130,686

(22) PCT Filed: Nov. 20, 2009

(86) PCT No.: PCT/FR2009/052235
§ 371 (c)(1),
(2), (4) Date: May 23, 2011

(87) PCT Pub. No.: WO2010/058137
PCT Pub. Date: May 27, 2010

(65) Prior Publication Data

US 2011/0236203 A1 Sep. 29, 2011

(30) Foreign Application Priority Data

Nov. 21, 2008 (FR) ..... 08 57904

(51) Int. Cl.
*F01D 25/28* (2006.01)
*F01D 11/00* (2006.01)
*F01D 9/04* (2006.01)
(Continued)

(52) U.S. Cl.
CPC ..... *F01D 11/005* (2013.01); *F01D 9/04* (2013.01); *F01D 11/08* (2013.01); *F01D 25/246* (2013.01); *F05D 2230/64* (2013.01);
(Continued)

(58) Field of Classification Search
CPC ..... F01D 11/005; F01D 11/08; F01D 11/12; F01D 11/122; F01D 9/04; F01D 25/246; F05D 2240/11; F05D 2240/55; F05D 2240/57; F05D 2230/64; F05D 2260/30
USPC ..... 415/173.1–173.5, 174.2, 213.1, 214.1
See application file for complete search history.

(56) References Cited

U.S. PATENT DOCUMENTS 4,699,254 A * 10/1987 Mery ..... 188/73.36
4,759,687 A 7/1988 Miraucourt et al.
(Continued)

FOREIGN PATENT DOCUMENTS

EP 1 104 836 6/2001
JP 2001-526346 A 12/2001
(Continued)

OTHER PUBLICATIONS

ECS Tuning, "Rear Brake Caliper Anti Rattle Clip", 2009, http://www.ecstuning.com/BMW-E39-540i-M62_4.4I/ES60202/, retrieved on Feb. 19, 2013.*
(Continued)

*Primary Examiner* — Dwayne J White
*Assistant Examiner* — Alexander White
(74) *Attorney, Agent, or Firm* — Oblon, McClelland, Maier & Neustadt, L.L.P.

(57) ABSTRACT

A positioning member for presenting a ring segment for a turbine wheel mounted to rotate about an axis inside a casing. The member presents: a fastener portion for fastening to the casing; a resilient portion forming a spring; and a bearing portion connected to the resilient portion and serving to bear axially against the ring segment such that when the member is mounted the ring segment is pressed axially against a portion of the casing by the positioning member.

20 Claims, 4 Drawing Sheets

(51) Int. Cl.
*F01D 11/08* (2006.01)
*F01D 25/24* (2006.01)

(52) U.S. Cl.
CPC ..... *F05D 2240/11* (2013.01); *F05D 2250/70* (2013.01); *F05D 2260/30* (2013.01)

(56) References Cited

U.S. PATENT DOCUMENTS

| | | | | |
|---|---|---|---|---|
| 5,971,703 | A | 10/1999 | Bouchard | |
| 6,113,349 | A | 9/2000 | Bagepalli et al. | |
| 6,296,443 | B1 | 10/2001 | Newman et al. | |
| 6,568,903 | B1 | 5/2003 | Aksit et al. | |
| 6,675,584 | B1 | 1/2004 | Hollis et al. | |
| 2003/0202876 | A1 | 10/2003 | Jasklowski et al. | |
| 2004/0031270 | A1 | 2/2004 | Sileo et al. | |
| 2004/0031271 | A1 | 2/2004 | Jorgensen | |
| 2005/0242522 | A1 | 11/2005 | Lejars | |
| 2006/0255549 | A1* | 11/2006 | Amos et al. | 277/644 |
| 2007/0227839 | A1* | 10/2007 | Barrett et al. | 188/73.31 |
| 2010/0074745 | A1* | 3/2010 | Jones et al. | 415/209.3 |
| 2011/0189009 | A1* | 8/2011 | Shapiro et al. | 415/209.3 |

FOREIGN PATENT DOCUMENTS

| | | | |
|---|---|---|---|
| JP | 2003-222029 | A | 8/2003 |
| JP | 2005-282571 | A | 10/2005 |
| RU | 2 169 846 | C2 | 6/2001 |
| WO | 99 30009 | | 6/1999 |

OTHER PUBLICATIONS

Office Action issued Sep. 6, 2013 in Russian Patent Application No. 2011125322/06.
International Search Report issued Apr. 6, 2010 in PCT/FR09/052235 filed Nov. 20, 2009.
Japanese Office Action issued Sep. 24, 2013 in Patent Application No. 2011-536932 (English Translation only).
Decision on Grant issued Jan. 15, 2014 in Russian Patent Application No. 2011125322 (submitting English translation only).

* cited by examiner

RING SEGMENT POSITIONING MEMBER

BACKGROUND OF THE INVENTION

1. Field Of The Invention

The present invention relates to the field of turbomachine turbines, and more particularly for those that are to be found in gas turbines.

The present invention relates more precisely to a turbomachine having a positioning member for positioning a ring segment for a turbine wheel that is mounted to rotate about an axis inside a casing.

2. Description Of The Related Art

Traditionally, the wheels of turbomachine turbines, such as the high pressure turbines of helicopter gas turbines, are surrounded by a ring that is concentric about the turbine wheel. As a component element of the stator of the turbomachine, the ring forms an outer shroud for the turbine stage. In other words, the burnt gas leaving the combustion chamber flows between the hub of the turbine wheel and the ring in such a manner as to drive the turbine wheel in rotation.

Generally, the ring is constituted by a plurality of ring segments, also referred to as ring sectors, that are placed contiguously one after another.

These ring segments are generally not fastened securely to the turbomachine casing since they are liable to expand axially and radially as a result of the high temperatures conveyed by the burnt gas.

The ring segments are held inside the casing by one or more positioning members.

Furthermore, it is common practice to provide for cooling the ring segments by causing a cooling fluid to flow around the ring, the cooling fluid possibly being bled from the compressed air that is generated by the turbomachine compressor.

Nevertheless, such a configuration presents the drawback of creating leakage zones, and it can readily be understood that the burnt gas might penetrate into the cooling circuit or, conversely, that the cooling fluid might penetrate into the gas flow section located upstream or downstream from the turbine wheel, which would penalize the efficiency of the turbomachine, with the penalty being worse when ejection takes place downstream.

To avoid leaks, document U.S. Pat. No. 5,988,975 proposes a solution that consists in providing radial sealing by means of a ring that keeps the ring segments pressed radially against the casing.

BRIEF SUMMARY OF THE INVENTION

An object of the present invention is to provide a turbomachine including an alternative positioning member that serves to provide sealing between the gas flow section and the cooling circuit.

The invention achieves this object by the fact that the positioning member presents:

- a fastener portion for fastening to the casing;
- a resilient portion forming a spring; and
- a bearing portion connected to the resilient portion and serving to bear axially against the ring segment in such a manner that when said member is mounted, the ring segment is pressed axially against a portion of the casing by the positioning member.

In the meaning of the present invention, the terms "axial" and "radial" should be considered relative to the axis and to a radius of the turbine wheel, whereas the term "downstream" should be understood with reference to the flow direction of burnt gas through the turbine.

Thus, once each ring segment is held axially against an (upstream or downstream) portion of the casing that is normal to the axis of rotation, by means of the axial force exerted by the bearing portion of the positioning member, it follows that sealing is provided between the cooling fluid circuit and the gas flow section.

In other words, with the positioning member fastened to the casing by means of the fastener portion, the axial force generated by the resilient portion is transmitted to the bearing portion and then to the ring segment. In the absence of the positioning member, the ring segment is suitable for moving a little relative to the casing in an axial direction, so it can readily be understood that the bearing portion pushes the ring segment against the casing portion, thereby pressing it against said casing portion. Preferably, the bearing portion pushes the ring segment against the portion of the casing that is downstream.

In another variant, the fastener portion also bears against the ring segment.

Preferably, the resilient portion is located between the fastener portion and the bearing portion.

Preferably, the casing portion against which the ring segment is pressed is normal to the axis of rotation of the turbine wheel.

Advantageously, the positioning member includes at least a first arm carrying the fastener portion.

Preferably, this first arm is designed to extend axially.

In a first variant, the fastener portion is in the form of a tab extending orthogonally relative to a plane in which the first arm extends.

Thus, when the positioning member is mounted, the tab extends radially. It serves in particular to be clamped between two component portions of the casing.

In another variant, the fastener portion comprises a hole with an axis that extends orthogonally relative to a plane in which the first arm extends. In this variant, the casing is fastened, by way of example and not necessarily, by means of a nut-and-bolt system, such that the first arm of the positioning member is prevented from moving axially relative to the casing.

Advantageously, the resilient portion is constituted by a corrugated tongue, this tongue being a fine metal plate, for example, e.g. a flexible sheet, presenting a plurality of successive folds. Nevertheless, it is possible to devise other types of resilient portion.

Furthermore, the corrugations are preferably located between the fastener portion and the bearing portion.

In a first embodiment, the positioning member is in the form of a tongue having a first end constituting the fastener portion that presents an orthogonal tab and a second end constituting the bearing portion that is curved, with the middle portion located between the first and second ends being corrugated so as to constitute the resilient portion.

In another embodiment, the positioning member comprises at least a first arm carrying the fastener portion, together with at least a second arm including the resilient portion, the resilient portion preferably being constituted by corrugations.

In an advantageous aspect of the invention, the first and second arms are parallel and extend from a plate, and the fastener portion is situated at one end of the first arm remote from the plate, while the bearing portion is situated at the end of the second arm that is remote from the plate.

An advantage of the fastener portion being close to the bearing portion (in particular the point where the positioning member is fastened to the casing being close to the bearing portion) is to limit the effect of the deformation (under temperature effect) of the casing, of the segments, or of the positioning system between the bearing portion and the fastener portion. This also limits the forces that are applied to the segments and consequently improves the behavior of the ring segments.

Preferably, the positioning member further includes a third arm similar to the second arm extending from the plate, the first arm extending between the second and third arms. Thus, the positioning member is E-shaped, with the three branches thereof being constituted by the first, second, and third branches. More precisely, these three branches extend axially when the positioning member is mounted with the ring segment.

An advantage of this positioning member is that it also makes it possible to retain two consecutive ring segments in an azimuth direction. To do this, each of the ring segments is held in an azimuth direction between the first arm of a first positioning member situated at one of the ends of the segment and the first arm of a second positioning member situated at the other end of the segment.

Furthermore, the first arm also preferably includes a second resilient portion located between the plate and the fastener portion, thereby further improving the resilience of the positioning member.

In another embodiment of the invention, the first arm forms a plate for covering a junction with a gap defined between two contiguous ring segments. Under such circumstances, one of the ends of the covering plate preferably includes the above-mentioned tab for fastening the positioning to the casing. Thus, the covering plate serves to improve sealing by covering the gap that might exist between the two ends of two contiguous segments.

In another embodiment, the resilient portion is constituted by a pair of arms in a V-shape extending from a plate. Under such circumstances, the resilient portion is constituted by a pair of resilient arms, which pair is suitable for returning to its initial shape after being deformed.

In this embodiment, the bearing portion is advantageously constituted by the ends of said arms, which ends are designed to bear axially against the ring segment so as to press it against the (downstream or upstream) portion of the casing that extends normally to the axis of rotation.

The present invention thus provides a turbomachine, e.g. but not necessarily for a helicopter, the turbomachine including a casing, a turbine wheel mounted to rotate about an axis inside casing, and a ring arranged concentrically around the turbine wheel, said ring being made up of at least first and second ring segments, said turbomachine further including at least one positioning member as described above, the positioning member being fastened to the casing and exerting axial thrust on at least one of ring segments so as to press it axially against a portion of the casing.

In a preferred manner, the positioning member presents a fastener portion for fastening it to the casing, which fastener portion is situated close to said casing portion in order to avoid being affected by the axial expansion of the ring segments.

Said portion is preferably a downstream portion of the casing.

Advantageously, the positioning member includes a first arm fastened to the casing, a resilient second arm exerting axial thrust on the first ring segment, and a resilient third arm exerting axial thrust on the second ring segment, so as to press the ring segments axially against a portion of the casing. Preferably, the first and second ring segments are contiguous.

In preferred manner, the turbomachine of the invention further includes at least one plate covering the junction between the first and second contiguous ring segments, the covering plate being held radially against the segments by the positioning member.

Preferably, the positioning member includes a resilient portion constituted by a tongue that presents corrugations, the tongue bearing radially against the cover plate in order to hold it radially against the contiguous ends of the first and second ring segments.

Preferably, the corrugations present radial flexibility so as to absorb vibration of the cover plate. Furthermore, this radial flexibility serves to hold the cover plate radially against the ends of the segments whatever the pressure difference that might exist between the gas flow section and the cavities inside the casing.

Another advantage of the positioning member is that it serves to absorb vibration of the segments.

By virtue of its corrugated portions, the positioning member may also bear radially both against the ring sector or the sealing tongue, and against the portion of the casing or ring support. Contact against these two parts serves to reduce or even eliminate any radial offset or clearance between the ring sectors, thereby ensuring controlled radial positioning of these sectors: this is particularly advantageous for ensuring control over clearances in the turbine, and thus over the performance thereof.

BRIEF DESCRIPTION OF THE SEVERAL VIEWS OF THE DRAWINGS

The invention can be better understood and its advantages appear better on reading the following description of embodiments given as non-limiting examples. The description refers to the accompanying drawings, in which.

DETAILED DESCRIPTION OF THE INVENTION

Figure 1:
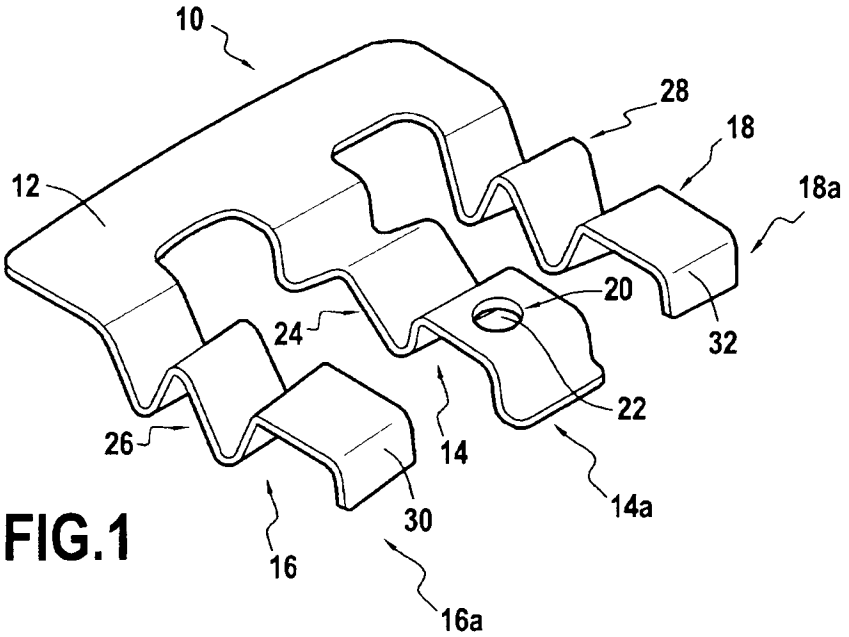
FIG. 1 is a perspective view of a first embodiment of the positioning member of the turbomachine of the invention.
Figure 2:
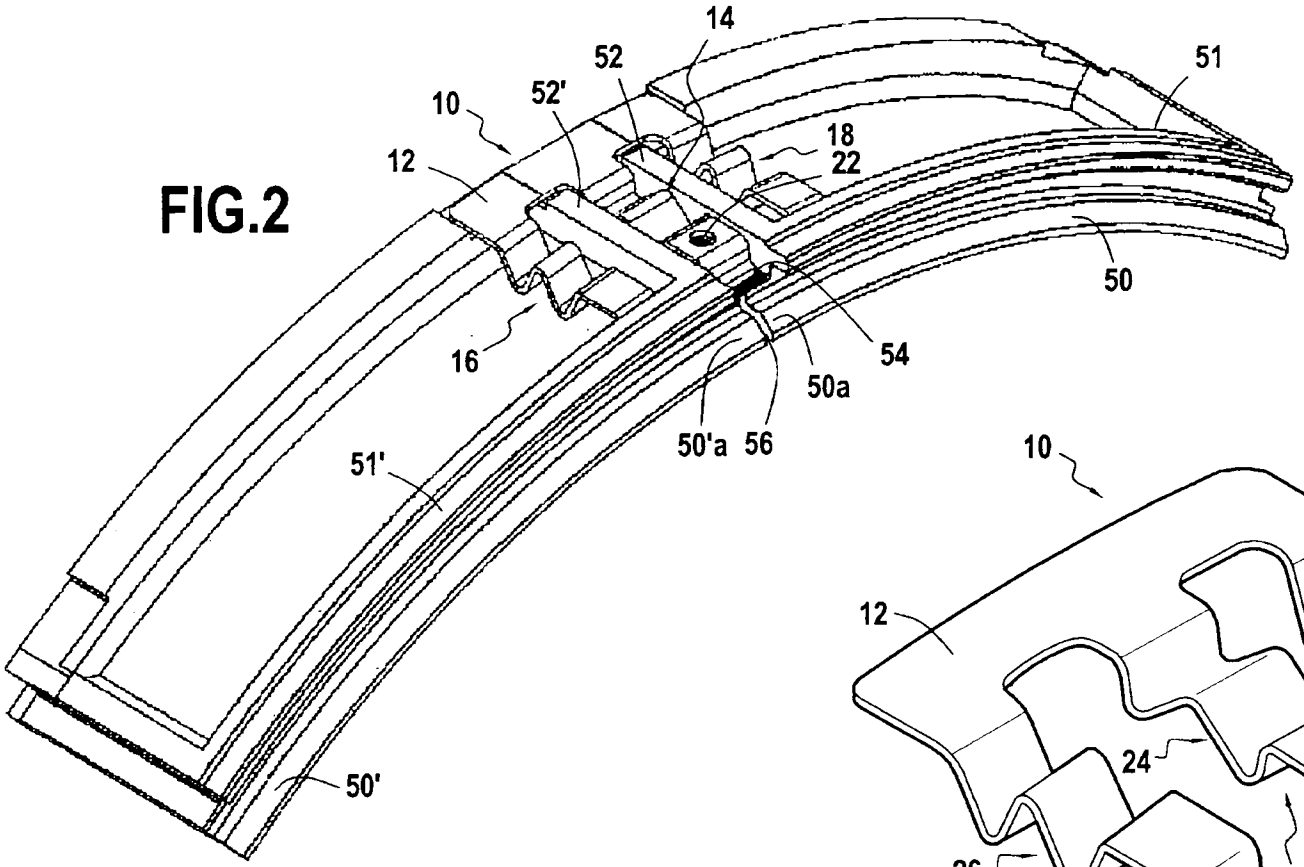
FIG. 2 is a fragmentary perspective view of a turbine ring, showing two ring segments held together by a positioning member of FIG. 1.
Figure 3:
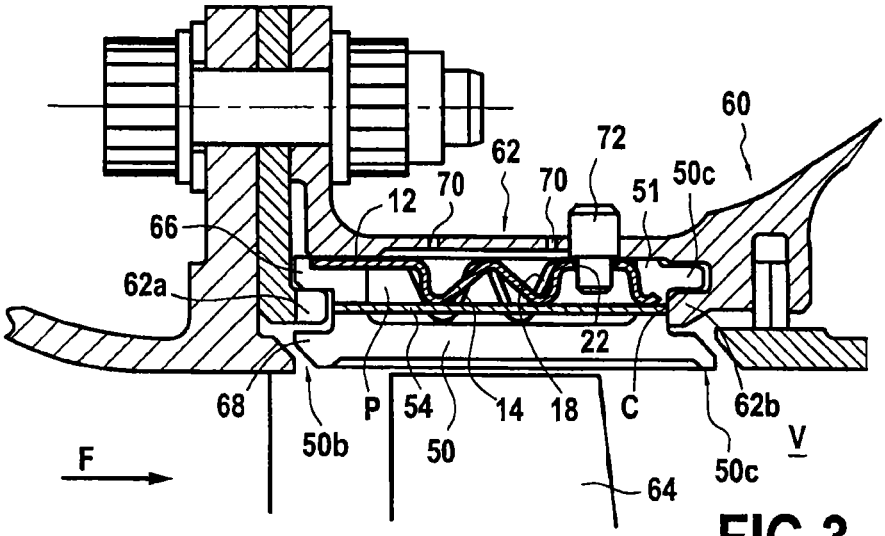
FIG. 3 is a fragmentary axial section view of a turbomachine showing the positioning member of FIG. 1 when mounted.

With reference to FIGS. 1 to 3, there follows a description of a first embodiment of the invention.

In the invention, a positioning member 10 serves to position a turbine ring segment relative to a casing of the turbomachine in which the turbine is rotatably mounted.

As can be seen in FIG. 1, the positioning member 10 is generally in the form of the letter "E". It comprises a plate 12 from which there extend orthogonally a central first arm 14 together with second and third arms given references 16 and 18, said arms being such as to constitute the three branches of the letter "E". Said arms are substantially parallel to one another.

Furthermore, the positioning member 10 presents thickness that is small compared with its other dimensions. More precisely, each of the arms is in the form of a corrugated tongue.

In accordance with the invention, the positioning member 10 presents a fastener portion 20 that, in this embodiment, is constituted by a hole 22 formed in the free end 14*a* of the first arm 14, i.e. in its end remote from the plate 12. In similar manner, the free ends of the second and third arms 16 and 18 are referenced 16*a* and 18*a*.

This fastener portion 20 is for fastening to the casing 62 of the turbomachine so as to fasten the positioning member 10 to the casing of the turbomachine. This aspect is described below.

Each of the first, second, and third arms 14, 16, and 18 also includes a resilient portion 24, 26, or 28 that forms a spring.

Each of these resilient portions 24, 26, and 28 is in the form of corrugations. In other words, each of the arms 14, 16, and 18 presents a succession of folds so as to form corrugations, it being specified that the folding axes extend transversely relative to said arms.

These corrugations 24, 26, and 28 can be deformed in the longitudinal direction of the arms 14, 16, and 18, but they tend to return to their original shape. The corrugations 26 and 28 of the second and third arms constitute compression springs in the sense that if an attempt is made to move the free ends towards the plate, then the corrugations as deformed in this way generate an opposing force referred to as a compression force. In contrast the corrugation 24 constitutes a traction spring. An advantage of this provision is explained below.

Furthermore, the positioning member 10 has two bearing portions 30 and 32 that are constituted by the free ends 16*a* and 18*a* of the second and third arms 16 and 18. As can be seen in FIG. 1, the free ends 16*a* and 18*a* are curved so as to form hook-like shapes.

Furthermore, and preferably, the second and third arms 16 and 18 are slightly longer than the first arm 14.

With reference to FIGS. 2 and 3, there follows an explanation of how the positioning member 10 is mounted.

Conventionally, the ring of a turbine is made up of a plurality of ring segments that are placed contiguously end to end. FIG. 2 shows the first and second ring segments 50 and 50' placed in abutment via their respective ends 50*a* and 50'*a*.

The shape of the ring is such that it defines an axial direction, a radial direction, and an azimuth direction, these three directions being mutually orthogonal. As mentioned above, the ring is designed to be placed around the turbine wheel of the turbomachine.

A first advantage of the positioning member 10 is that it holds the ends 50*a* and 50'*a* so as to prevent the ring segments 50 and 50' from turning about the axis of the turbine wheel. To do this, each of the ring segments 50 and 50' carries a spline 52 or 52' extending in a transverse direction relative to the ring segment while also projecting radially, such that when the positioning member 10 is mounted, the plate 12 extends along the azimuth direction of the ring segments 50 and 50', and while the first and second arms 14 and 16 lie on either side of the spline 52' of one of the ring segments 50', while the first and third arms 14 and 18 of the member 10 lie on either side of the spline 52 of the other ring segment 50. Consequently, it can be understood that the positioning member 10 prevents the ends 50*a* and 50'*a* of each of the ring segments 50 and 50' from moving in an azimuth direction. Preferably, each segment 50 and 50' is held at each of its azimuth ends by two respective members 10.

As can be seen in FIG. 2, the bearing portions 30 and 32 of the positioning member 10, i.e., in this example, the free ends 16*a* and 18*a* of the second and third arms 16 and 18, come to bear axially against respective peripheral edges 51 and 51' of the first and second ring segments 50 and 50'. An advantage of this configuration is explained below.

Another advantage of the present invention can be better understood with reference to FIG. 3 which shows details of how the ring segment 50 and 50' and the positioning member are mounted in the casing 62 of the turbomachine 60.

As mentioned above, the ring segments 50 and 50' are placed around the wheel of the high pressure turbine so as to cover the blades 64 of said turbine. Arrows F represent the flow direction of burnt gas leaving the combustion chamber that is located upstream from the high pressure turbine.

As can be understood from FIG. 3, the axial ends 50*b* and 50*c* of the ring segments 50 present axial swellings 66 and 68 for co-operating with projections carried by the upstream and downstream portions 62*a* and 62*b* of the casing 62 so that the ring segment 50 is held radially in the casing 62. Nevertheless, the ring segments 50 are mounted in the casing 62 with a small amount of axial clearance.

Furthermore, it can be seen that casing 62 and the ring segments 50 and 50' are arranged in such a manner as to define an annular passage P to allow cooling fluid to flow around the ring. Orifices 70 are formed in the casing 62 to enable the cooling fluid to be brought into contact with the ring segments in order to cool them.

In accordance with the invention, the positioning member 10 is fastened to the casing 62 by means of a fastener portion 20 by using a locking member of the nut and bolt or peg type 72, for example.

When the positioning member 10 is in the mounted position, its arms 14, 16, and 18 extend in the axial direction of the turbine wheel, while the plate 12 is housed between the upstream swelling 66 of the ring segment and the casing 62.

Furthermore, the point where the positioning member 10 is fastened, i.e. in this example the nut 72, is located relative to the downstream projection 62*b* of the casing 62 in such a manner that the corrugations 24, 26, and 28 of the member 10 are subjected to continuous axial compression in their longitudinal direction, thus causing the free ends 16*a* and 18*a* of the second and third arms 16 and 18 to exert axial thrust that is directed downstream against the peripheral edges 51, 51' of the ring segments 50 and 50'. As a result, the ring segments 50 and 50' are pressed axially against a downstream portion of the casing, which portion is constituted in this example by the above-mentioned downstream projection 62*b*. Contact between the ring segments 50 and 50' and the downstream portion of the casing 62*b*, which contact takes place via a contact zone given reference C, serves to provide sealing between the annular passage P and the downstream flow section V, thereby preventing the cooling fluid that flows in the annular passage from flowing into the downstream flow section V.

Another advantage is that the cooling fluid flowing in the annular passage also cools the corrugations 30 and 32 that might be caused to heat up. This makes it possible to control the lifetime of the corrugations, by optimizing their operating temperature.

Finally, in FIG. 3, it can be seen that the positioning member 10, and more precisely the corrugations 24 of the first arm 14, serves to keep a plate 54 radially against the contiguous ends of the first and second ring segments 50 and 50'. This plate 54 covers the junction 56 defined between the ends 50*a* and 50'*a* of the two ring segments as to improve sealing between the annular passage and the flow section in which the blades 64 of the turbine wheel move.

Another advantage of the positioning member 10 is that it pushes the ring segment at each of its axial ends in an azimuth direction, thereby improving contact between the ring segment 50 and the downstream portion 62*b* of the casing 62, and thus improving sealing. The positioning of the bearing at the ends of the segments 50 and 50' also serves to reduce any risk of the segments jamming in the grooves of the casing 62.

Figure 4:
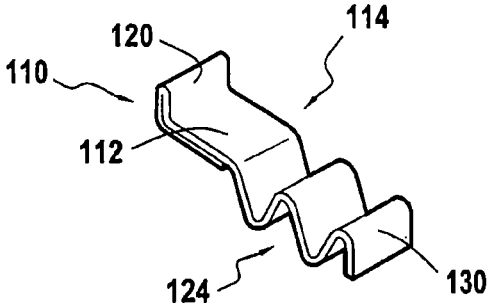
FIG. 4 is a perspective view of a second embodiment of the positioning member of the invention.
Figure 5:
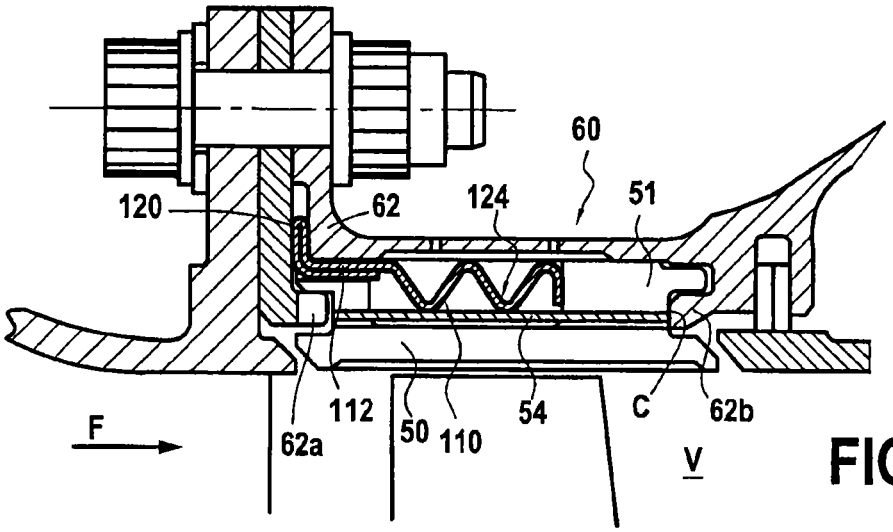
FIG. 5 is a fragmentary axial section view of a turbomachine having the FIG. 4 positioning member mounted therein.

With reference to FIGS. 4 and 5, there follows a description of a second embodiment of a positioning member 110 in accordance with the present invention. In this embodiment, elements that are identical to those of the first embodiment are given the same numerical references plus one hundred.

The positioning member 110 is in the form of a single arm 114 constituted by a tongue. Like the first embodiment, the arm or tongue 114 presents a resilient portion 124 forming a compression spring, this resilient portion being constituted by corrugations, the corrugations being made by folding the tongue 114 several times.

In addition, the member 110 presents a fastener portion 120 constituted by a tab that extends orthogonally relative to a plane in which the first arm 114 extends. This tab 120 may be made by folding the tongue 114 for example.

In order to be consistent with the first embodiment, it may be stated that the member 110 presents a plate 112 located between the tab 120 and the corrugations 124.

Finally, the tongue 114 has a bearing portion 130 constituted by the end of the tongue that is remote from the tab 120, which end is curved.

FIG. 5 shows the positioning member 110 mounted in the turbomachine 60.

The positioning member 110 is fastened to the casing 110 by the tab 120. To do this, the tab is received radially between the ring segment 50 and the casing 62.

The tongue 114 extends axially so that its free end 130 comes to bear against the edge 51 of the ring segment 50.

Furthermore, the length of the tongue 114 is selected so that when the ring segment is positioned axially against the downstream portion 62*b* of the casing, the corrugations 124 of the member 110 are compressed axially. It follows that the end 130 of the tongue exerts axial thrust against the peripheral edge 51 of the ring segment 50, thereby causing the ring segment to be pressed axially against the downstream portion 62*b* of the casing 62, and specifically to be pressed against the contact zone C.

It can thus be understood that the positioning member 110 advantageously keeps the ring segment 50 in axial contact with the downstream portion 62*b* of the casing 62.

Furthermore, the corrugations 124 of the member 110 enable the plate 54 to be held radially against the ends of the ring segments.

Figure 6:
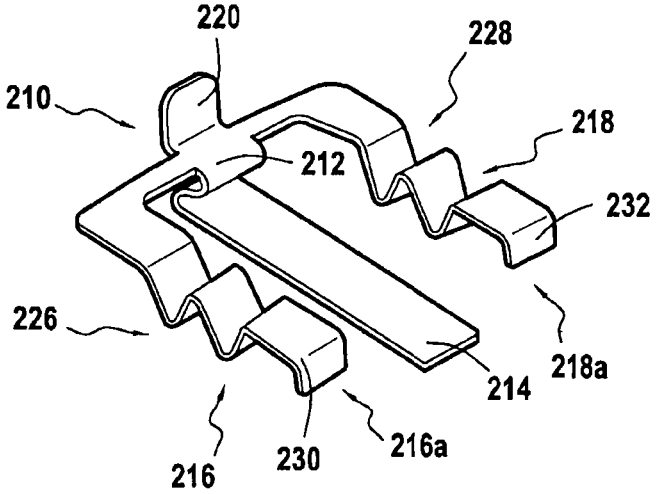
FIG. 6 is a perspective view of a third embodiment of the positioning member of the turbomachine of the invention.
Figure 7:
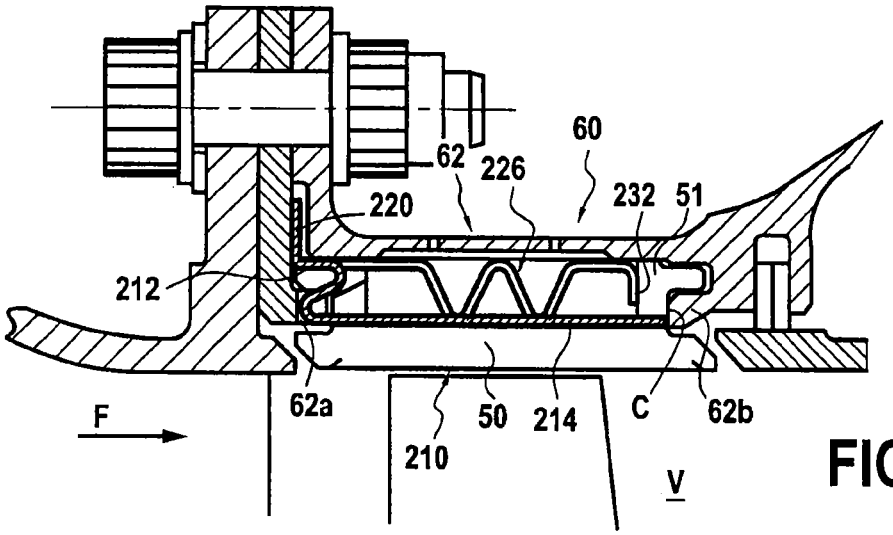
FIG. 7 is a fragmentary axial section view of a turbomachine having the FIG. 6 positioning member mounted therein.

With reference to FIGS. 6 and 7, there follows a description of a third embodiment of the invention.

In this embodiment, elements identical to those of the first embodiment are given the same numerical references plus two hundred.

The positioning member 210 in the third embodiment is generally E-shaped. In this respect, it has a central first arm 214 that forms a plate that is straight (without corrugations) for covering the junction between the two ends of the ring segments. In other words, the positioning member advantageously makes it possible to omit a junction-covering plate as described above, since the first arm 214 specifically performs the role of said junction-covering plate.

At one of the ends of the first arm 214 there is a plate 212 carrying a fastener portion 220 that is constituted by a tab similar to that of the second embodiment.

The plate 212 has second and third arms 216 and 218 projecting therefrom, similar to the second and third arms of the first embodiment. I.e. these arms include respective first and second resilient portions 226 and 228 forming corrugations.

Furthermore, the free ends 216*a* and 218*a* constitute bearing portions 230 and 232 similar to those of the first embodiment.

FIG. 7 shows the positioning member 200 when mounted in the casing 60. The tab 220 bears axially against the upstream portion 62*a* of the casing 62, while the free ends 216*a* and 218*a* of the second and third arms come to bear against the peripheral edge 51 of the ring segment 50 so as to press it axially against the downstream edge 62*b* of the casing 62. To do this, the second and third arms 216 and 218 are slightly longer than the distance between the upstream portion 62*a* of the casing and the edge 51 such that the corrugations 226 and 228 are in compression. As in the first embodiment, this compression of the corrugations generates axial thrust on the edges 51 of the contiguous ring segments downstream from the free ends 216*a* and 218*a* so that the ring segments 50 and 50' are pressed axially against the downstream portion 62*b* of the casing 62.

Figure 8:
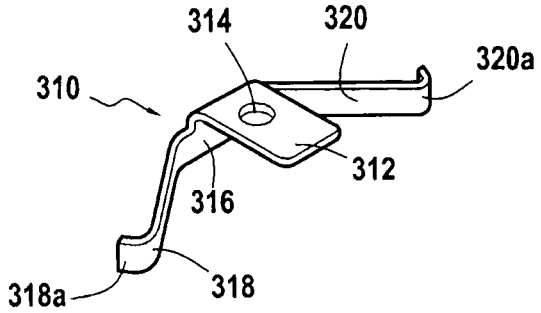
FIG. 8 is a perspective view of a fourth embodiment of the positioning member of the turbomachine of the invention.
Figure 9:
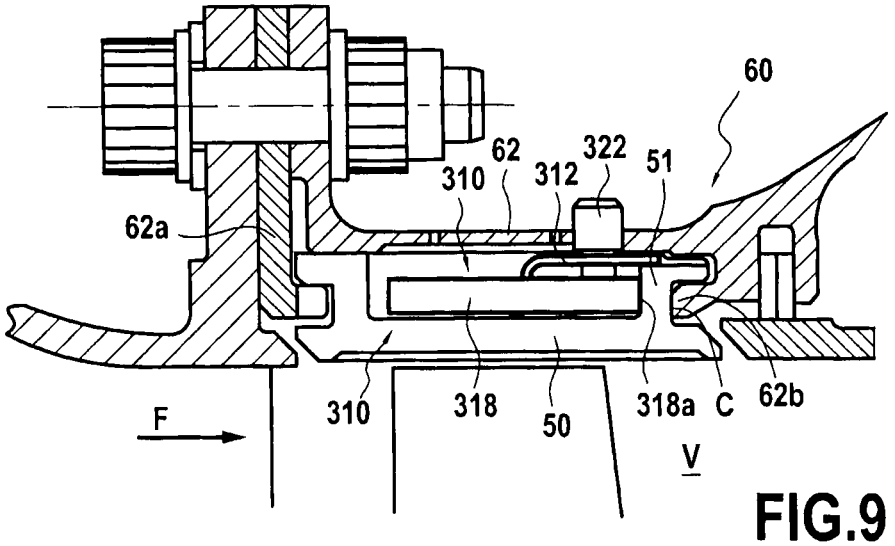
FIG. 9 is a fragmentary axial section view of a turbomachine having the FIG. 8 positioning member mounted therein.

With reference to FIGS. 8 and 9, there follows a description of a fourth embodiment of the invention. The positioning member 310 has a plate 312 provided with a hole 314 constituting a fastener portion for fastening to the casing 62.

A pair of arms 318, 320 constituting a V-shape extends in a curved portion 316 of the plate 312. The positioning member 310 is made of a material that presents a certain amount of stiffness, such that each of the arms 318 and 320 constitutes a resilient portion forming a compression spring. It can be understood that if any attempt is made to spread the arms apart from each other, they exert a return force that tends to bring the arms back towards their original, rest position. In other words, the arms 318 and 320 act like spring blades.

When the positioning member 310 is mounted in the manner shown in FIG. 9, it is fastened to the casing 62 by a nut 322 similar to that of the first embodiment.

Each arm is provided at its end 318*a*, 320*a* with a bearing portion that is hook-shaped.

In this embodiment, the ends 318*a* and 320*a* of the pairs of arms 318 and 320 serve to bear against the peripheral edge 51 in such a manner as to press the ring segments 50 and 50' against the downstream portion 62*b* of the casing 62. In this position, the arms 318 and 320 are slightly deformed so as to maintain axial pressure against the ring segment 50. The position of the fastener point, i.e. the nut or peg 322, or the length of the arms 318, 320 should be selected so as to obtain this effect.

The invention claimed is:

1. A turbomachine comprising:

a casing;

a turbine wheel rotatably mounted about an axis within the casing;

a ring mounted concentrically around the turbine wheel, the ring including at least first and second ring segments; and at least one positioning member presenting:

a fastener portion fastened to the casing;

a resilient portion forming a spring; and a bearing portion connected to the resilient portion and bearing axially against at least one of the first and second ring segments, the positioning member being fastened to the casing while exerting axial thrust on the at least one of the first and second ring segments so as to press the at least one of the first and second ring segments axially against a portion of the casing, wherein a downstream end of the at least one of the first and second ring segments includes upper and lower axial extending portions extending downstream and a contact portion extending radially therebetween so as to present a downstream facing groove, a downstream portion of the casing presents an upstream facing groove which holds the upper axial extending portion of the downstream end of the at least one of the first and second ring segments, and the contact portion abuts the downstream portion of the casing, wherein the positioning member comprises at least a first arm carrying the fastener portion, together with at least a second arm including the resilient portion, and wherein the first and second arms are parallel and extend from a plate, and wherein the fastener portion is situated at one end of the first arm remote from the plate, while the bearing portion is situated at one end of the second arm that is remote from the plate.

2. The turbomachine according to claim 1, wherein the fastener portion is in a form of a tab extending orthogonally relative to a plane in which the first arm extends.

3. The turbomachine according to claim 1, wherein the fastener portion comprises a hole having an axis which extends orthogonally relative to a plane in which the first arm extends.

4. The turbomachine according to claim 1, wherein the resilient portion comprises a corrugated tongue.

5. The turbomachine according to claim 1, wherein the positioning member further includes a third arm similar to the second arm extending from a plate, the first arm extending between the second and third arms.

6. The turbomachine according to claim 1, wherein the first arm further includes a second resilient portion disposed between a plate and the fastener portion.

7. The turbomachine according to claim 1, wherein the first arm forms a plate for covering a junction between two contiguous ring segments.

8. The turbomachine according to claim 1, wherein the positioning member includes a portion fastened to the casing, a resilient second arm exerting axial thrust on the first ring segment, and a resilient third arm exerting axial thrust on the second ring segment, thereby pressing the first and second ring segments axially against a portion of the casing.

9. The turbomachine according to claim 1, further comprising at least one plate covering a junction between the first and second ring segments, the plate being held radially against the ring segments by the positioning member.

10. The turbomachine according to claim 1, wherein an outer periphery of each of the first and second ring segments presents a cavity facing radially outward, a peripheral edge of the ring segment is provided at a downstream end of the cavity, and the bearing portion of the positioning member bears axially against the peripheral edge.

11. The turbomachine according to claim 1, wherein the bearing portion bears axially against a peripheral edge of the at least one of the first and second ring segments, the peripheral edge provided at the downstream end of the at least one of the first and second ring segments opposite of the downstream facing groove.

12. A turbomachine comprising:

a casing;

a turbine wheel rotatably mounted about an axis within the casing;

a ring mounted concentrically around the turbine wheel, the ring including at least first and second ring segments; and at least one positioning member presenting:

a fastener portion fastened to the casing;

a resilient portion forming a spring; and a bearing portion connected to the resilient portion and bearing axially against at least one of the first and second ring segments, the positioning member being fastened to the casing while exerting axial thrust on the at least one of the first and second ring segments so as to press the at least one of the first and second ring segments axially against a portion of the casing, wherein a downstream end of the at least one of the first and second ring segments includes upper and lower axial extending portions extending downstream and a contact portion extending radially therebetween so as to present a downstream facing groove, a downstream portion of the casing presents an upstream facing groove which holds the upper axial extending portion of the downstream end of the at least one of the first and second ring segments, and the contact portion abuts the downstream portion of the casing, wherein the positioning member comprises at least a first arm carrying the fastener portion, together with at least a second arm including the resilient portion, wherein the positioning member further includes a third arm similar to the second arm extending from a plate, the first arm extending between the second and third arms, wherein a circumferential end of each of the first and second ring segments includes a spline extending in a transverse direction relative to the ring section and projecting radially, and wherein when the positioning member is mounted, the plate extends along an azimuth direction of the ring segments, the first and second arms of the positioning member lie on either side of the spline of the first ring segment, and the first and third arms of the positioning member lie on either side of the spline of the second ring segment.

13. The turbomachine according to claim 12, wherein the fastener portion is in a form of a tab extending orthogonally relative to a plane in which the first arm extends.

14. The turbomachine according to claim 12, wherein the fastener portion comprises a hole having an axis which extends orthogonally relative to a plane in which the first arm extends.

15. The turbomachine according to claim 12, wherein the resilient portion comprises a corrugated tongue.

16. The turbomachine according to claim 12, wherein the first arm further includes a second resilient portion disposed between a plate and the fastener portion.

17. The turbomachine according to claim 12, wherein the first arm forms a plate for covering a junction between two contiguous ring segments.

18. The turbomachine according to claim 12, further comprising at least one plate covering a junction between the first and second ring segments, the plate being held radially against the ring segments by the positioning member.

19. The turbomachine according to claim 12, wherein an outer periphery of each of the first and second ring segments presents a cavity facing radially outward, a peripheral edge of the ring segment is provided at a downstream end of the cavity, and the bearing portion of the positioning member bears axially against the peripheral edge.

20. The turbomachine according to claim 12, wherein the bearing portion bears axially against a peripheral edge of the at least one of the first and second ring segments, the peripheral edge provided at the downstream end of the at least one of the first and second ring segments opposite of the downstream facing groove.

* * * * *